US007603973B2

(12) United States Patent
Flierl et al.

(10) Patent No.: US 7,603,973 B2
(45) Date of Patent: Oct. 20, 2009

(54) VARIABLE MECHANICAL VALVE CONTROL FOR AN INTERNAL COMBUSTION ENGINE

(75) Inventors: Rudolf Flierl, Kaiserslautern (DE); Mark Andy Mohr, Tettnang (DE); Bastian Volpert, Waldsee (DE)

(73) Assignees: Hydraulik-Ring GmbH, Marktheidenfeld (DE); Entec Consulting GmbH, Hemer (DE)

( * ) Notice: Subject to any disclaimer, the term of this patent is extended or adjusted under 35 U.S.C. 154(b) by 0 days.

(21) Appl. No.: 11/897,921

(22) Filed: Aug. 30, 2007

(65) Prior Publication Data

US 2008/0087240 A1 Apr. 17, 2008

Related U.S. Application Data

(63) Continuation of application No. PCT/EP2006/001925, filed on Mar. 2, 2006.

(30) Foreign Application Priority Data

Mar. 3, 2005 (DE) ..... 10 2005 010 182
Mar. 14, 2005 (DE) ..... 10 2005 012 081
Oct. 18, 2005 (DE) ..... 10 2005 049 671

(51) Int. Cl.
*F01L 1/34* (2006.01)

(52) U.S. Cl. ..... 123/90.16; 123/90.39; 74/569

(58) Field of Classification Search ..... 123/90.16, 123/90.2, 90.27, 90.31, 90.39, 90.44, 90.61; 29/888.2; 74/559, 567, 569
See application file for complete search history.

(56) References Cited

U.S. PATENT DOCUMENTS 2,954,017 A * 9/1960 Forstner ..... 123/90.16
3,413,965 A 12/1968 Gavasso
4,572,118 A * 2/1986 Baguena ..... 123/90.16
4,617,903 A 10/1986 Heberle et al.
4,934,348 A 6/1990 Yagi et al.
5,241,928 A 9/1993 Hamada et al.
5,479,903 A 1/1996 Werner et al.
5,546,914 A 8/1996 Scheinert
5,603,292 A 2/1997 Håkansson
5,682,854 A 11/1997 Ozawa
6,814,039 B2 11/2004 Kreuter et al.
6,907,852 B2 6/2005 Schleusener et al.
6,997,153 B2 2/2006 Schon et al.
2004/0103865 A1 6/2004 Duesmann
2004/0144347 A1 7/2004 Schleusener et al.
2004/0177820 A1 9/2004 Kreuter et al.
2004/0261737 A1 12/2004 Rohe et al.
2005/0028766 A1 2/2005 Schon et al.

(Continued)

FOREIGN PATENT DOCUMENTS

AT 005 398 6/2002

(Continued)

*Primary Examiner*—Ching Chang
(74) *Attorney, Agent, or Firm*—Lipsitz & McAllister, LLC

(57) ABSTRACT

A variable mechanical valve control for an internal combustion engine is provided having an underhead camshaft for adjusting a valve stroke and an opening and closing time, making it possible to achieve a very compact transmission gear between the push rod drive and the intake and exhaust valves, to reduce the number of components required for the transmission gear, and to obtain a mechanical, completely variable valve train with an underhead camshaft.

15 Claims, 12 Drawing Sheets

U.S. PATENT DOCUMENTS

2007/0074687 A1 4/2007 Bosl-Flierl et al.

FOREIGN PATENT DOCUMENTS

| | | |
|---|---|---|
| CH | 664 194 | 2/1988 |
| CZ | 276 476 | 1/1992 |
| DE | 1165 342 | 3/1964 |
| DE | 1 715 690 | 1/1971 |
| DE | 2 256 091 | 5/1974 |
| DE | 24 28 915 | 1/1976 |
| DE | 43 03 574 | 9/1993 |
| DE | 689 11 212 | 4/1994 |
| DE | 43 26 159 | 2/1995 |
| DE | 43 30 913 | 3/1995 |
| DE | 44 24 802 | 7/1995 |
| DE | 195 81 571 | 2/1997 |
| DE | 196 14 825 | 4/1997 |
| DE | 196 19 775 | 4/1997 |
| DE | 196 40 520 | 4/1998 |
| DE | 694 14 386 | 4/1999 |
| DE | 100 36 373 | 2/2002 |
| DE | 100 41 466 | 3/2002 |
| DE | 101 23 186 | 11/2002 |
| DE | 101 40 635 | 4/2003 |
| DE | 101 64 493 | 7/2003 |
| DE | 202 20 138 | 4/2004 |
| DE | 103 11 069 | 6/2004 |
| DE | 103 14 683 | 11/2004 |
| EP | 0 111 768 | 6/1984 |
| EP | 1 387 050 | 2/2004 |
| FR | 2 472 078 | 6/1981 |
| JP | 2004316444 | 11/2004 |
| WO | 00/09868 | 2/2000 |
| WO | 2004088094 | 10/2004 |
| WO | 2004088099 | 10/2004 |

* cited by examiner

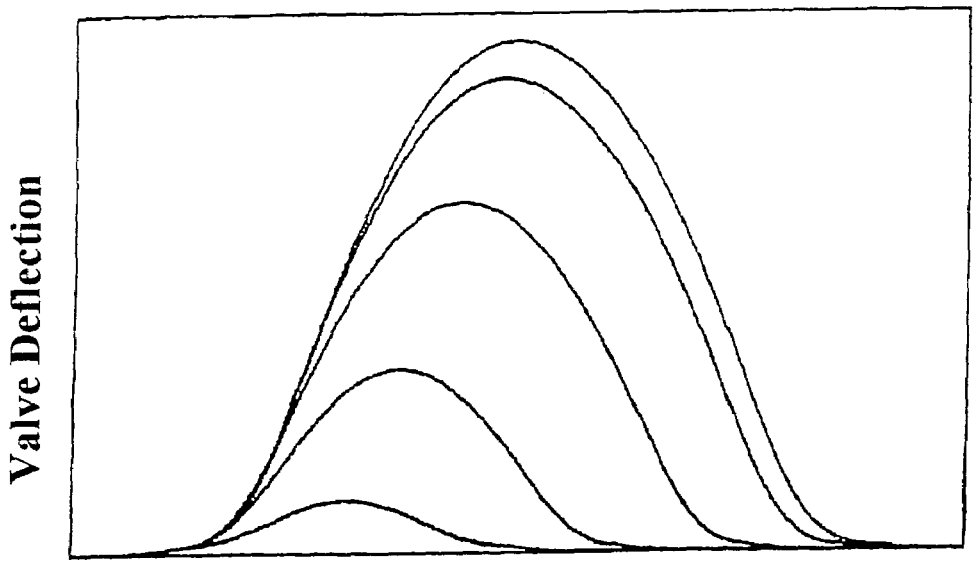
Fig. 22 Control Shaft Angle of Rotation
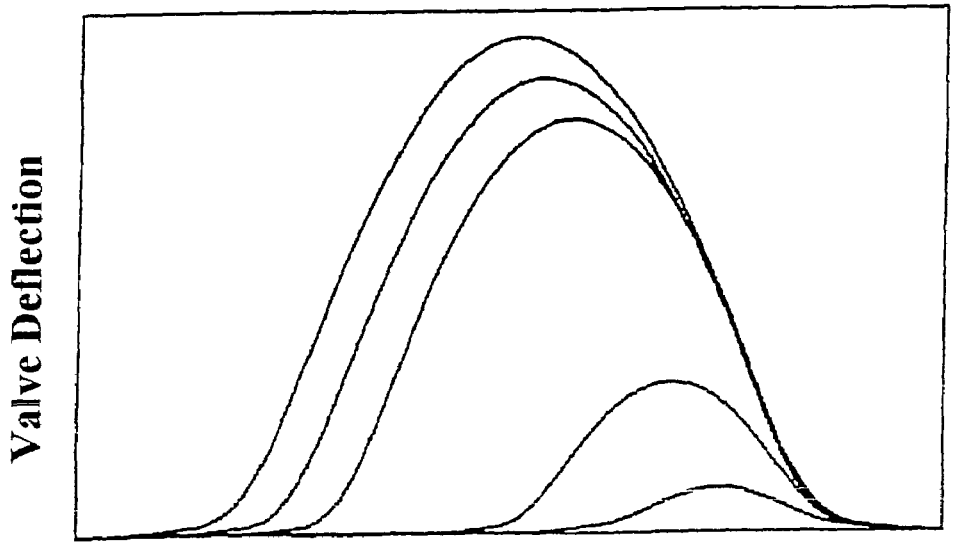
Fig. 23 Control Shaft Angle of Rotation

VARIABLE MECHANICAL VALVE CONTROL FOR AN INTERNAL COMBUSTION ENGINE

This application is a continuation of International patent application No. PCT/EP2006/001925 filed on Mar. 2, 2006 and claims the benefit of German patent application no. 10 2005 010 182.8 filed Mar. 3, 2005, German patent application No. 10 2005 012 081.4 filed Mar. 14, 2005, and German patent application No. 10 2005 049 671.7 filed Oct. 18, 2005, each of which is incorporated herein and made a part hereof by reference.

BACKGROUND OF THE INVENTION

The invention relates to a variable mechanical valve control for an internal combustion engine for regulating the control timing, the opening time and/or the stroke of gas exchange valves, intake and exhaust valves, and for actuating fuel valves of an internal combustion engine, particularly of engines having push rod or rocker arm trains.

Known are internal combustion engines with an underhead camshaft, in which a push rod driven by the camshaft or the cams themselves directly actuate(s) a rocker arm, which opens and closes the valve either directly or by way of further transmission members. In this process, however, neither the control timing nor the valve stroke or the valve opening duration is usually varied continuously. If such mechanically variable valve stroke controls have only a camshaft, on which the cams for the intake and exhaust liftings of the valves are provided simultaneously, the time point of the opening and closing of the intake valve cannot be controlled independently of the time point of opening and closing of the exhaust valve. Used in a known way for shifting the opening time points between intake and exhaust valves is a phase shifter, the cam geometries for the intake and exhaust valve stroke being provided on different camshafts. The intake camshaft is then shifted relative to the exhaust camshaft for the phase shifting.

Also known are internal combustion engines with an overhead camshaft, in which a cam driven by a control shaft directly actuates a rocker arm, which, either directly or by way of further transmission members, opens and closes a gas exchange valve. In this process, however, neither the control timing nor the valve stroke or the valve opening duration is varied continuously. If such mechanically variable valve stroke controls have only a control shaft, on which the cams for the intake and exhaust liftings of the valves are provided simultaneously, it is not possible to control the time point of the opening or closing of the intake valve independently of the time point of the opening or closing of the exhaust valve. Used in a known way for shifting the opening time points between intake and exhaust valves is a phase shifter, the cam geometries for the intake and exhaust valve stroke being provided on different camshafts. The intake camshaft is then shifted relative to the exhaust camshaft for the phase shifting.

Known from DE 103 14 683 A1 is a variable valve stroke control for an internal combustion engine having an underhead camshaft, in which the valve stroke of one or more intake and/or exhaust valves can be adjusted depending on load and rpm, so that, simultaneously with the valve stroke, also the opening time of the valves is adjusted. Known further from DE 100 41 466 A1 and DE 43 30 913 A1 are valve trains for controlling the intake and exhaust control timings of gas exchange valves and of the fuel intake control for an internal combustion engine. In both systems, however, a great effort must be put into keeping the valve play within a certain tolerance. Known, furthermore, are numerous variable valve trains that can adjust both the valve stroke and the opening time of the valve nearly continuously. All described variable valve trains utilize at least one variably adjustable transmission member to transmit the cam stroke by way of this transmission member to a valve actuating member, which produces the valve stroke. All of these systems are capable of producing a high variability of the valve stroke. However, most of these valve trains are described for overhead camshafts. Described in DE 101 40 635 A1 is a valve stroke mechanism for independent variable stroke adjustment of the gas exchange valves of an internal combustion engine, in which the valve stroke characteristic is created by the geometry of the slide gate path, by the contour of the adjusting strip, and by an operating curve of the rocker arm, so that the two intake valves of a 4-valve engine having different stroke curves are actuated by this stroke mechanism. Known from DE 1 751 690 and DE 2 256 091 are valve control units that, depending on the load and rpm, can change the valve stroke of a valve for internal combustion engines with an underhead camshaft. However, both of these are based on sliding contacts and accordingly result in problems entailing friction and thus power loss.

A drawback of the known mechanical variable valve trains having an underhead camshaft or rocker arms is that these valve trains use an additional lever, which transmits the movement of the push rod onto the intermediate member, which is responsible for the variability of the valve stroke curves. This thus results, for the same functionality, in more components and joint or contact sites. This further leads to greater problems in terms of tolerance as well as stiffness. In addition, the number of components and joint or contact sites has negative consequences for the system costs. A shifting of the control timing or a phase shifting of the maximum valve stroke is not provided for in this system. For the known systems described here, both the valve stroke and the valve opening time as well as the control timing or the phase position of the stroke maximum cannot be changed, even though the described systems are able to fulfill individual requirements placed on a mechanically variable valve train. However, there does not exist any system that can shift both the opening time and the stroke as well as the spread angle of the valves. Moreover, for an engine with only one camshaft, these systems do not provide for the possibility of adjusting separately the valve stroke parameters for the intake and exhaust valves.

Therefore, the problem of the present invention consists in creating a valve train for an internal combustion engine having an underhead camshaft or rocker arms with variable valve stroke and variable opening and closing times, making it possible to achieve a very compact transmission gear between the push rod drive or control shaft and the intake and exhaust valves, to reduce the number of components required for the transmission gear, and, in addition, to obtain a mechanical, completely variable valve train having an expanded variability of the valve train, particularly for engines with push rod or rocker arm trains.

SUMMARY OF THE INVENTION

According to a first aspect of the invention, an intermediate lever is linked to a push rod by means of a axle in such a way that a slide gate roller, which is rotatably mounted on the axle and is driven by the camshaft, is moved in a slide gate, whereby a first contact surface on the intermediate lever is supported on an eccentric axle or on a second contact surface and a lever can be moved over an operating curve, by way of which the gas exchange valves are opened and/or closed. The support of the first contact surface can be assisted or reinforced by means of an elastic element—for example, a spring.

On a tappet provided on the tappet push rod, means can be provided for the additional shifting of the phase position of the valve liftings of the gas exchange valves with simultaneous play-free adjustment of the valve stroke and/or means are provided for additional independently controllable valve stroke opening and closing for each camshaft revolution.

Key advantages of the present invention consist in the compact design of the transmission gear arranged between the cam drive and the valve actuating mechanism, particularly for internal combustion engines with an underhead camshaft. Further achieved through the coupling of the intermediate lever to the tappet push rod is a completely variable valve train, in which the number of components of the transmission gear is very small. The system tolerances of the transmission gear can be markedly improved in comparison to known valve trains of the prior art. A further great advantage of the new variable mechanical valve control according to the invention consists in the fact that both the valve stroke and the valve opening time as well as the phase position of the stroke maximum can be changed independently of one another.

It is advantageous that the levers, which are placed directly above the gas exchange valves, can be constructed as rocker arm or pivoting levers and that the path of the slide gate can be defined by an arc around the center point of a lever roller and a first portion of the operating curve by an arc around the center point of the slide gate roller. In doing so, it can be provided that, for an internal combustion engine having at least two intake and/or exhaust valves, the corresponding intermediate levers and the levers arranged directly above the gas exchange valves have different geometries for the valve actuation and are not provided on a common axle.

Preferably, it is provided that the lever provided above the gas exchange valves directly actuates simultaneously two gas exchange valves by way of a valve bridge. An advantageous embodiment is seen in the fact that the contact surface of the intermediate lever to the eccentric shaft is a component of a rotatably mounted roller. This affords a low-friction operation of the transmission gear.

Owing to the fact that the present invention enables, among other things, the variation of the valve stroke to be executed from a maximum stroke all the way to a zero stroke, it is possible for there to occur a valve shutdown of individual valves all the way to the shutdown of all valves of a cylinder.

An especially advantageous further development of the variable mechanical valve control for an internal combustion engine having an underhead camshaft is seen in that, independent of the valve stroke variation, the phase position of the valve stroke maxima can be executed by way of another adjusting element, which comprises an eccentric shaft having a coupling point and is coupled to the tappet or pivoting lever; through a rotation of the eccentric shaft, a preset change in the phase position and valve liftings of the gas exchange valves can be effected. Furthermore, it is possible that, depending on the change in the axial position of the tappet push rod with the tappet in opposing directions with respect to the central axle of the camshaft, the valve opening time points or the valve closing time points can be differently adjusted, so that, for example, the valve opening time points are the same for different valve stroke curve families and the closing time points change as a function of the cam angle. For other designs of internal combustion engines, it may be advantageous to keep the closing time points of the valve stroke curve families constant and to change the opening beginnings of the valve lifting curves. To this end, the adjusting element can change the axial position of the tappet push rod correspondingly.

Further advantageous embodiments consist in the fact that the adjustment of the intake and exhaust valve liftings are effected separately and differently from each other and that the camshaft has at least one secondary cam, by means of which a second opening and closing of the intake and/or exhaust valves is effected for each camshaft revolution. This allows, in particular, the residual gas control of engines to be controlled advantageously by variation in the secondary stroke. This advantage is of particular advantage for internal combustion engines that, as a means for additional independent valve stroke opening and closing for each camshaft revolution, are provided with a second actuating system for a secondary stroke. The second actuating system allows the valve adjustable opening of the gas exchange valves independent of the opening of a primary stroke.

Another advantageous further development is seen in the fact that a fixed axle for the intermediate lever is provided, the intermediate lever not being guided by several contacts, which offers advantages for the valve train dynamics. In addition, this guiding on one axle results in a reduction in the number of components and thus the displaced and undisplaced mass in the valve train as well as the design height of the valve train. Advantageously, it is provided that the intermediate lever moves an intermediate member over the operating curve, by means of which at least one gas exchange valve is actuated and/or that the valve strokes, the valve opening time, and the phase position of the stroke maximum can be changed with respect to one another in a specific relative dependence.

Preferably, it is provided that, on a pivoting lever arranged on the tappet push rod, means for adjusting the phase position, the stroke, and the opening time of the valve liftings of the gas exchange valves with simultaneous play-free adjustment are provided and/or that the fixed axle is provided in alignment to the position for at least one intermediate lever in the cylinder head.

For some embodiments of the mechanically variable valve train, it is advantageous that the fixed axle for neighboring intermediate axes has non-aligned positionings in the cylinder head.

For cylinder heads, particularly for diesel engines, it may be advantageous that the intermediate levers and the levers of neighboring gas exchange valves in the cylinder head have different geometries with respect to the fixed axle in the cylinder head. Particularly for valve drives with intake and exhaust conduits that are constructed nonsymmetrically for the twisting action relative to the longitudinal axis of the cylinder head, it is possible to adapt the drive means of the variable valve train for the gas exchange valves to the geometric ratios of the gas exchange conduits, with different lever geometries being advantageous.

Another advantage of this invention consists in the fact that, for the force coupling of the transmission gear to the levers, the springs are dispensed with, depending on the geometry, or that, for the force coupling of the transmission gear to the intermediate levers or to the tappet, springs are provided, again depending on the geometry.

A further great advantage of the variable mechanical valve control consists in the fact that both the valve stroke and the valve opening time as well as the phase position of the stroke maximum may be changed in a play-free manner with respect to one another in specific relative dependence. Depending on the position of the longitudinal axis of the tappet push rod in relation to the central axle of the camshaft, the maximum of the variable valve stroke curve family can be shifted in phase by a variable adjustment of the tappet or of a correspondingly designed pivoting lever that is provided.

It is further advantageously provided for that the intermediate lever moves an intermediate member over the operating curve, by means of which the at least one gas exchange valve is actuated.

Key advantages of the present invention consist in the compact design of the transmission gear, which can be arranged between the cam drive and the valve actuation, particularly for internal combustion engines having an underhead camshaft. Furthermore, the coupling of the joint at the intermediate lever with the tappet push rod makes it possible to achieve a completely variable valve train, in which the number of components of the transmission gear is very small and, owing to the small number of components, the system friction of the transmission gear is minimized. The dynamic behavior of the valve train is optimized by the elimination of contact sites.

Further advantageous embodiments consist in the fact that simply the option for a secondary cam is afforded.

Another friction-minimizing embodiment is seen in the fact that the fixed axle of the intermediate lever is mounted on roller bearings in order to provide for a low-friction operation of the transmission gear.

Another aspect of the invention provides that an intermediate lever is linked by way of an axle to the control shaft roller in such a way that a slide gate roller, which is rotatably mounted on the axle and is driven by the camshaft, is moved in a slide gate by way of a camshaft roller and by way of the axle, whereby a contact surface on the intermediate lever is supported on a control shaft, preferably in a spring-reinforced manner, and an operating curve moves a rocker arm or pivoting lever, by means of which the gas exchange valves are opened and/or closed. Attached to at least one of the camshafts or control shafts is a phase shifter, so that a phase shift between the camshaft and the control shaft, which rotate at the same speed, is provided such that, during the variable valve control for different valve strokes, either the valve opening time point or the valve closing time point is the same for the different valve strokes. The camshaft can have the same direction of rotation as the control shaft or an opposite direction of rotation.

Key advantages of the present invention consist in the compact design of the transmission gear, which is arranged between the control shaft drive and the valve actuation, particularly for internal combustion engines with rocker arms or pivoting levers. The system tolerances of the transmission gear can be markedly improved in comparison to the known valve drives of the prior art. A further great advantage of the variable mechanical valve control according to the invention consists in the fact that both the valve stroke and the valve opening time as well as the phase position of the stroke maximum can be changed by only one adjustment.

It is also advantageous that the levers, which are disposed directly above the gas exchange valves can be constructed as a rocker arm or pivoting lever. The path of the slide gate can be defined by an arc around the center point of a lever roller and/or a first portion of the operating curve by an arc around the center point of the slide gate roller. For an internal combustion engine having at least two intake and/or exhaust valves, the corresponding intermediate levers and levers that are arranged directly above the gas exchange valves can have different geometries for the valve actuation and can be mounted either on a common axle or on different axles.

Preferably, it is provided that the lever provided above the gas exchange valves directly actuates two gas exchange valves simultaneously by way of a valve bridge.

An advantageous embodiment is seen in the fact that the contact surface of the intermediate lever for the control shaft is a component of a rotatably mounted roller. A low-friction operation of the transmission gear is thereby afforded.

Owing to the fact that the present invention enables, among other things, the variation of the valve stroke to be executed from a maximum stroke all the way to a zero stroke, it is possible for there to occur a valve shutdown of individual valves all the way to the shutdown of all valves of a cylinder.

An especially advantageous further development of the variable mechanical valve control for an internal combustion engine with rocker arms is seen in that, dependent on the valve stroke variation, the phase position of the valve stroke maxima can be produced by way of only one adjusting element and by a permanent rotation of the control shaft, resulting in a preset change in the phase position and valve liftings of the gas exchange valves. Furthermore, it is possible that, depending on the shifting of the phase position of two control shafts with respect to each other, in relation to the maximum deviation of the two control shafts, the valve opening time points or the valve closing time points are differently adjustable, so that, for example, the valve opening time points are the same for different valve stroke curve families and the closing time points are changed by way of the control shaft angle. For other designs of internal combustion engines, it may be advantageous to keep the closing time points of the valve stroke curve families constant and to change the opening beginnings of the valve lifting curves. To this end, the phase position of the two control shafts is to be changed correspondingly by the adjusting element.

Further advantageous embodiments consist in the fact that the adjustment of the intake and exhaust valve liftings are effected separately and differently from each other. The camshaft may have at least one secondary cam, by means of which a second opening and closing of the intake and/or exhaust valves is effected for each camshaft revolution. This allows, in particular, the residual gas control of engines to be controlled advantageously by variation of the secondary stroke. This advantage is of particular interest for internal combustion engines that are not provided, as a means for a secondary stroke for additional independent valve stroke opening and closing for each control shaft revolution, with a second actuating system, wherein the second actuating system allows the valve opening of the gas exchange valves to be effected differently and independently from the opening of a primary stroke.

BRIEF DESCRIPTION OF THE DRAWINGS

The invention is discussed in greater detail below on the basis of preferred exemplary embodiments illustrated in the drawings.

Shown are:

FIG. 22 a valve stroke curve family of the exemplary embodiment of the variable valve train with constant valve opening time point; and FIG. 23 a valve stroke curve family of another exemplary embodiment of the variable valve train with constant valve closing point.

DETAILED DESCRIPTION

Figure 1:
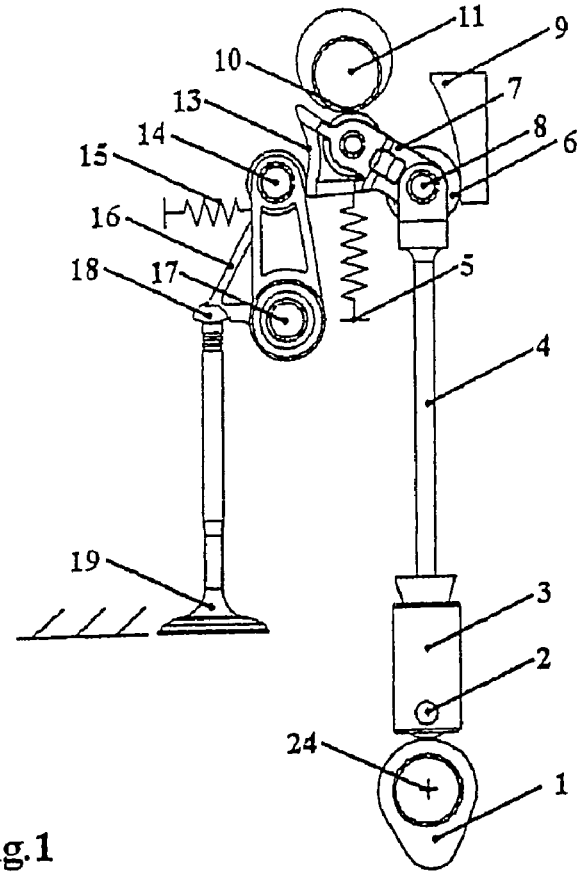
FIG. 1 a first exemplary embodiment, in side view, of a variable valve train of a gas exchange valve having an underhead camshaft.

FIG. 1 shows, in a first exemplary embodiment, a variable valve train, consisting of a camshaft 1 and a cam follower 2, which rolls on a cam of the camshaft 1 and is deflected. The cam follower 2 is rotatably mounted in a tappet 3, which is guided linearly (perpendicularly). A tappet push rod 4 is rotatably mounted on the top side of the tappet 3. The tappet push rod 4 is rotatably mounted in an axle 8 and linked to an intermediate lever 7. The intermediate lever 7 is supported by way of a slide gate roller 6, a first contact surface 10, and a lever roller 14. By way of a displacement of the eccentric shaft 11, the intermediate lever 7 is rocked relative to the center of rotation of the slide gate roller 6. A lever 16 is rotatably mounted in a lever fulcrum 17. A gas exchange valve 19 is actuated by way of the lever 16. The cam stroke is transmitted, according to FIG. 1, by way of the tappet 3 and the tappet push rod 4, which is articulated with the tappet 3, to the intermediate lever 7, the tappet 3 also being provided as a pivoting lever. Both the tappet and the pivoting lever 3 can be in contact with a cam of the camshaft 1 either by way of a sliding contact or by way of a rolling contact. The tappet push rod 4 is linked by way of a ball-and-socket, swivel, or turn-and-slide joint to the tappet 3. The intermediate lever 7 rolls with the slide gate roller 6 in a slide gate 9. In addition, the intermediate lever 7 is supported with the first contact surface 10 on the eccentric shaft 11. The first contact surface 10 can also be a component of a rotatably mounted roller of the intermediate lever 7.

Deflected by the cam stroke, the intermediate lever 7 rocks, so that the lever roller 14, mounted rotatably on the lever 16, rolls on an operating curve 13 of the intermediate lever 7. Depending on the positioning by the eccentric shaft 11 or a sliding block, different regions of the operating curve 13 come into contact with the lever roller 14. If the lever roller 14 is in contact with the zero-stroke region of the operating curve 13, no movement of the lever 16 is produced in spite of the pivoting of the intermediate lever 7 and accordingly the gas exchange valve 19 is not actuated. If the lever roller 14 is in contact with the stroke region of the operating curve 13, the lever 16 and, with it, also the gas exchange valve 19 are actuated. The longer the lever roller 14 rolls on the zero-stroke region by adjusting the intermediate lever 7, the shorter it rolls in the stroke region and the smaller is the valve stroke, going all the way down to zero stroke, when only the zero-stroke region of the operating curve 13 is traversed during the cam stroke. Moreover, the opening time point shifts later and the closing time point shifts earlier symmetrically to the maximum cam stroke.

In order to be able to ensure a force coupling between all components, several springs 5, 15 can be incorporated into the system. The kind, number, and positioning of the springs 5 and 15 depends on the configuration and layout of the system.

Figure 2:
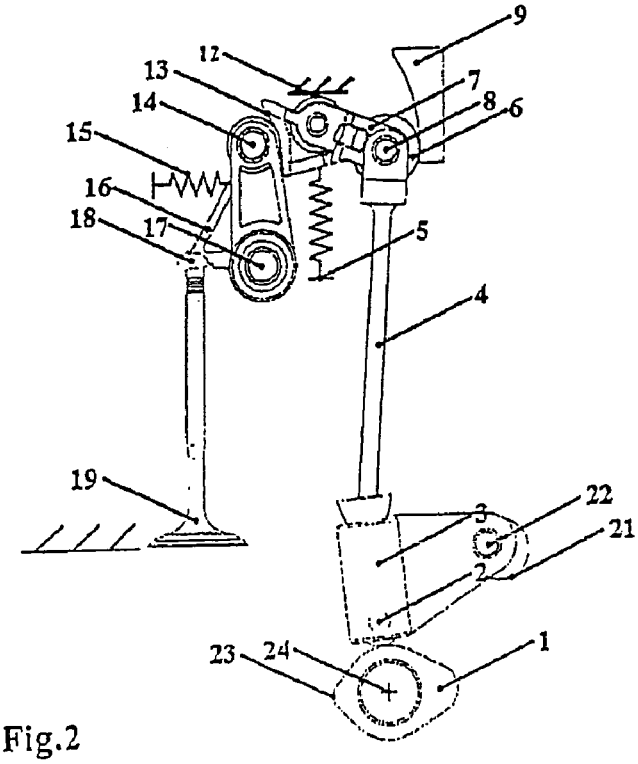
FIG. 2 a second exemplary embodiment of the variable valve train for an engine with shifting of the phase position and adjustment of the valve stroke.

The second exemplary embodiment, illustrated in FIG. 2, of the variable valve train has a shifting element, which comprises an eccentric shaft 22 with a coupling point 21 and is coupled to the tappet or pivoting lever 3, whereby, through a rotation of the eccentric shaft 22, a preset change in the phase position and the valve liftings of the gas exchange valves 19 is provided. In place of the shifting by the eccentric shaft 11, only the second contact surface 12 is provided as support of the intermediate lever 7 in this exemplary embodiment.

Figure 3:
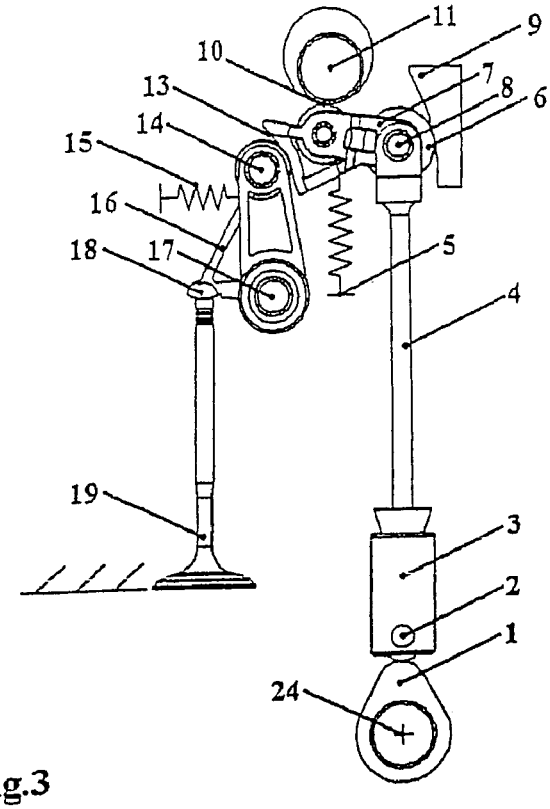
FIG. 3 the variable valve train when the transmission gear is set for a zero-stroke position at maximum cam stroke.
Figure 4:
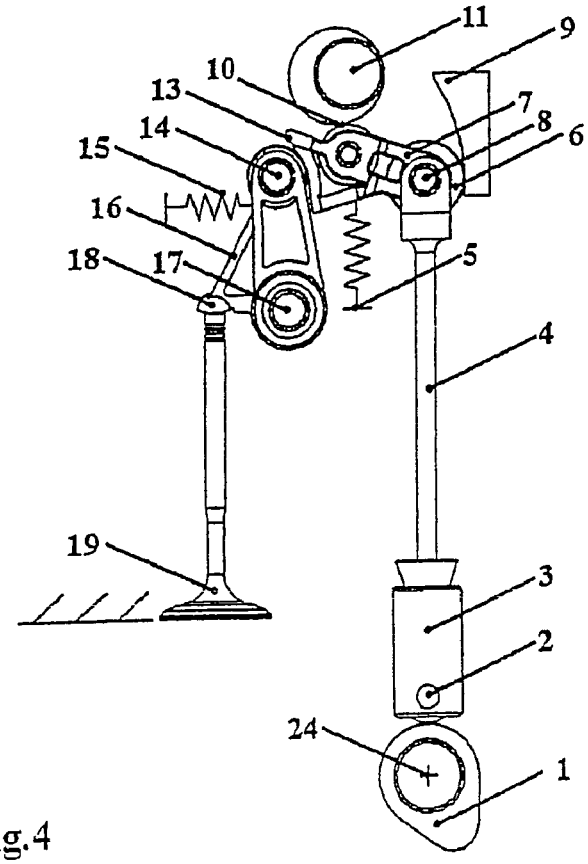
FIG. 4 the variable valve train when the transmission gear is set for a zero-stroke position for a cam base-circle position.
Figure 5:
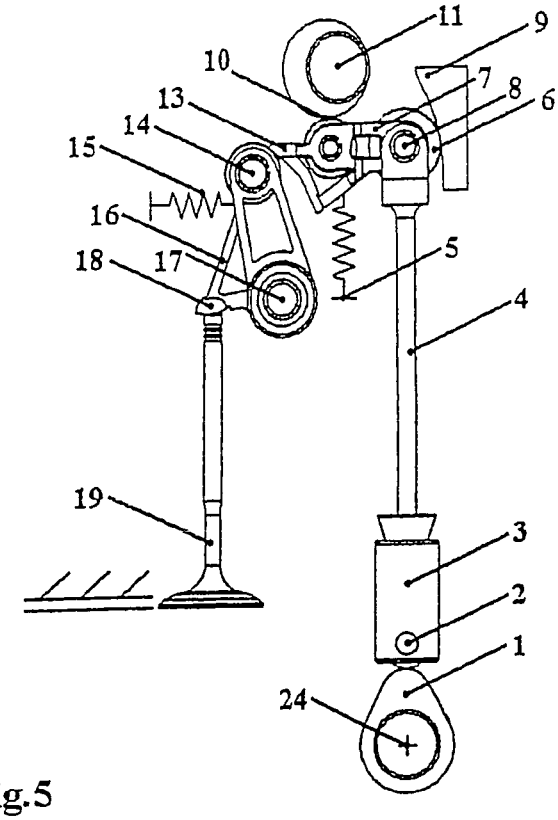
FIG. 5 the variable valve train when the transmission gear is set for a partial-stroke position at maximum cam stroke.

Illustrated in FIGS. 3 to 5 are different valve stroke positions of the variable valve train. Illustrated in FIG. 3 for the maximum cam stroke position is the transmission gear for a position in which the gas exchange valve 19 makes a zero stroke. In FIG. 4, a zero-stroke position is also set on the gas exchange valve 19, this time with a cam stroke position for the position of the camshaft 1 in a base-circle position. In FIG. 5, a partial-stroke position of the gas exchange valve 19 is adjusted.

Figure 6:
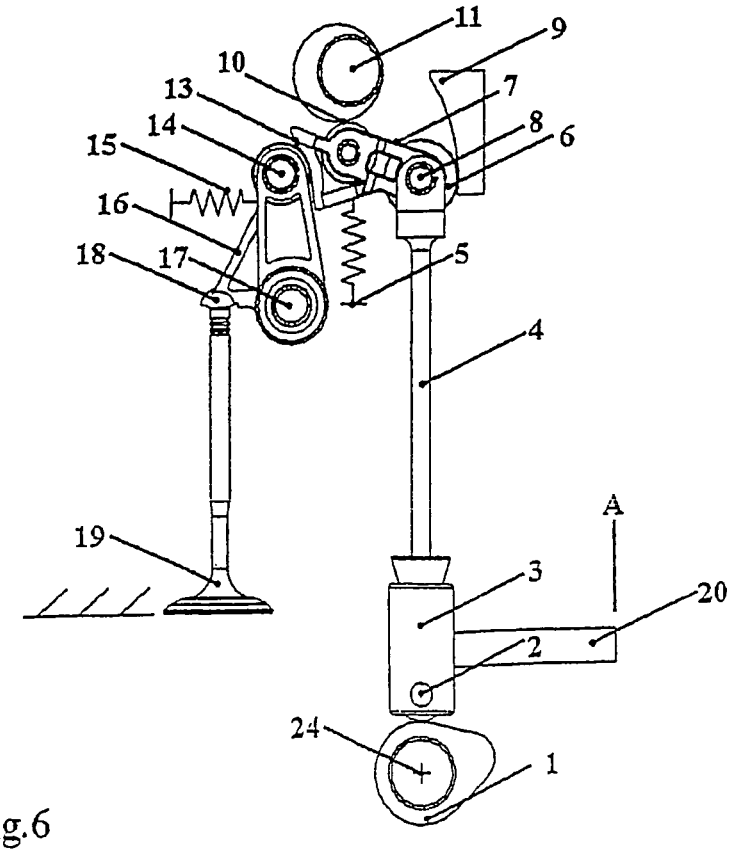
FIG. 6 the variable valve train when the transmission gear is set for a zero-stroke position with a linear displacement A.

Illustrated in FIG. 6 is an adjustable linear guide 20, by means of which the phase position and the valve stroke can be additionally designed so as to be changed. The spread A can be changed depending on the position of the linear guide 20.

Figure 7:
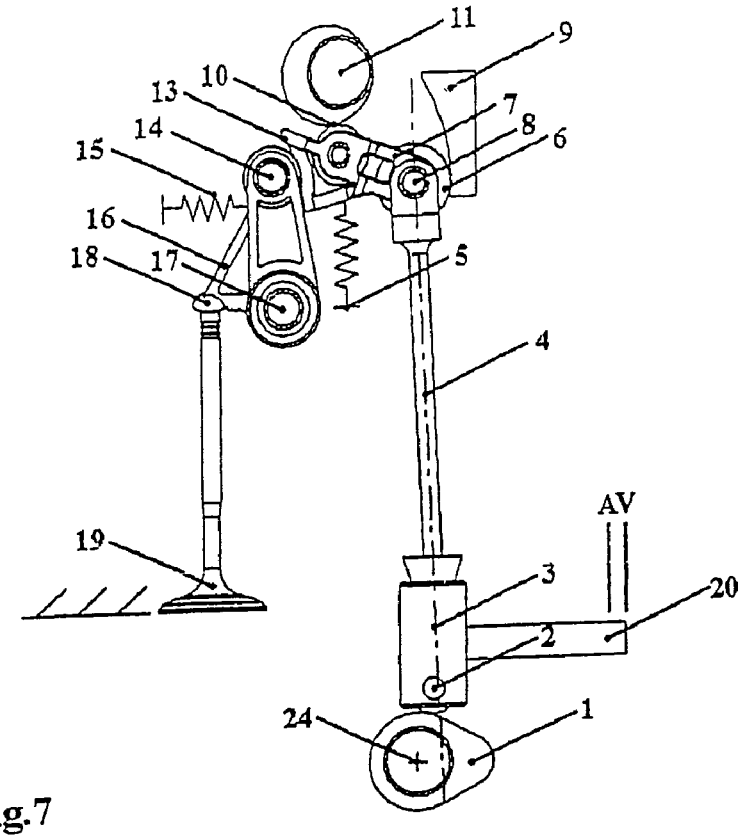
FIG. 7 the variable valve train when the transmission gear is set for a zero-stroke position with a linear displacement AV.

Illustrated in FIG. 7 for this linear guide 20 is a position with a spread displaced AV, for which the axle of the tappet push rod 4 runs off-center of a central axis 24 of the camshaft 1. The contribution of the linear guide 20 is indicated by AV. By means of the changeable linear guide 20, the phase position and the valve stroke of the valve control can be variably adjusted.

Figure 8:
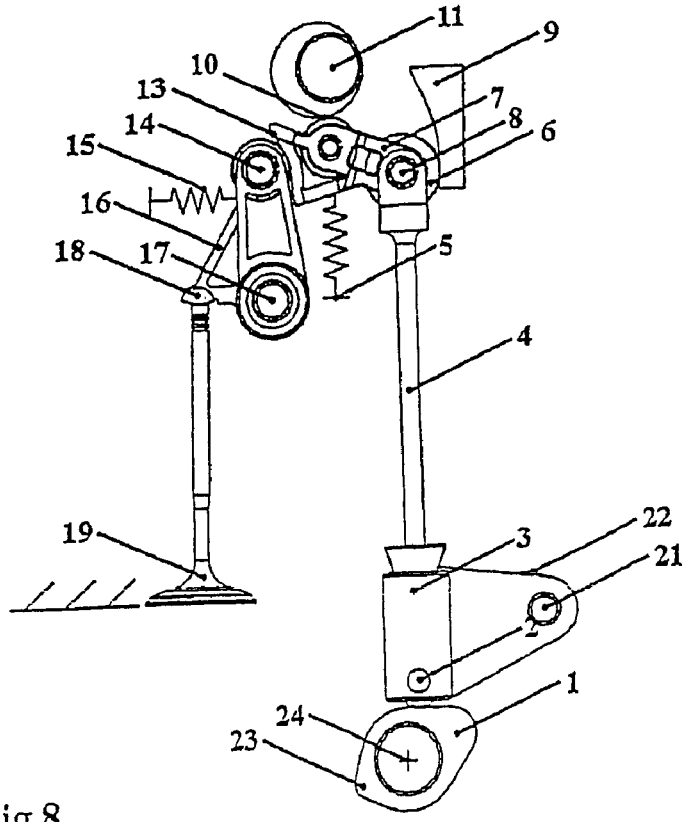
FIG. 8 the variable valve train when the transmission gear is set for a zero-stroke position with eccentric displacement and secondary cam.

Illustrated in FIG. 8 is a secondary cam 23 for another exemplary embodiment of the variable valve train on the camshaft 1. Depending on the camshaft revolution, the gas exchange valve 19 is additionally opened and closed by the secondary cam 23. This additional opening of the gas exchange valve 19 can be utilized as a residual gas control in engines. A portion of the exhaust from the last combustion cycle remains in the cylinder. This allows the emission of pollutants from the internal combustion engine to be reduced.

It is advantageous for the internal combustion engine when the secondary cam 23 can be additionally also variably actuated by a variable valve control that exists independent of the control of the gas exchange valve 19. In an embodiment of the variable valve control, which is not illustrated in greater detail, a second actuating system for a secondary stroke is provided as a means for additional independent valve stroke opening and closing for each camshaft revolution, the second actuating system using such means to effect the valve opening of the gas exchange valves 19 in a changeable manner and independently from the opening of a primary stroke. There also exists the possibility of dividing the primary and secondary strokes onto two cams. By using two cam followers 2 on a common tappet 3, the secondary stroke can be completely cut out, when necessary, by way of a "lost motion" element. In doing so, the cam follower 2 of the secondary stroke is placed with the lost motion element on the tappet 3 and the cam follower 2 of the primary stroke is constantly linked in a fixed manner to the tappet 3.

When the primary and secondary strokes are divided onto two cams, it is also possible to use two actuating systems, which consist of two cam followers 2 or two pivoting levers, two tappet push rods 4, and two intermediate levers 7, although these two systems actuate only one common lever 16. Through a separate or coupled control of the two actuating systems, it is possible to adjust freely with respect to one another the phase position and the height and opening time of the valve stroke. With one cam each for the primary stroke and the secondary stroke, it is also possible to use two separate pivoting levers in place of the tappet 3 for the two cams of the camshaft 1, of which only one is linked to the tappet push rod 4. If the two intermediate levers 7 are linked together, both cam strokes are utilized. By adjusting the intermediate lever 7 so far by way of the eccentric shaft 11 that the lever roller 14 is actuated already in the base-circle phase by the stroke region of the operating curve 13, it is possible to achieve a constant slight opening of the gas exchange valve 19, such as is necessary for a constant throttle engine braking function.

Further illustrated in FIG. 8 is another adjusting means for changing the phase position and the valve stroke of the variable valve control in the form of an eccentric shaft displacement with an eccentric shaft 22 and a coupling point 21.

Figure 9:
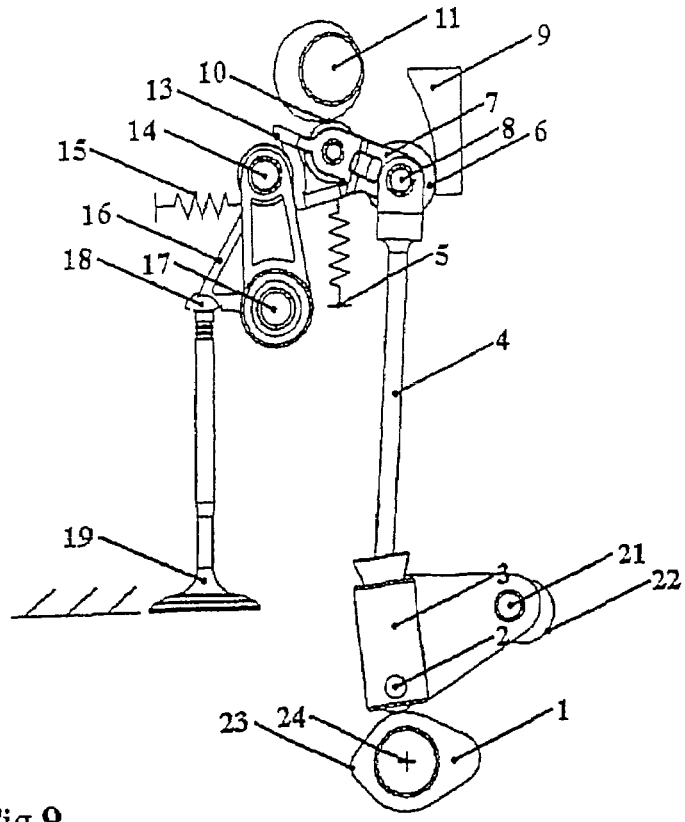
FIG. 9 the variable valve train when the transmission gear is set for a zero-stroke position with maximum eccentric displacement and secondary cam.
Figure 10:
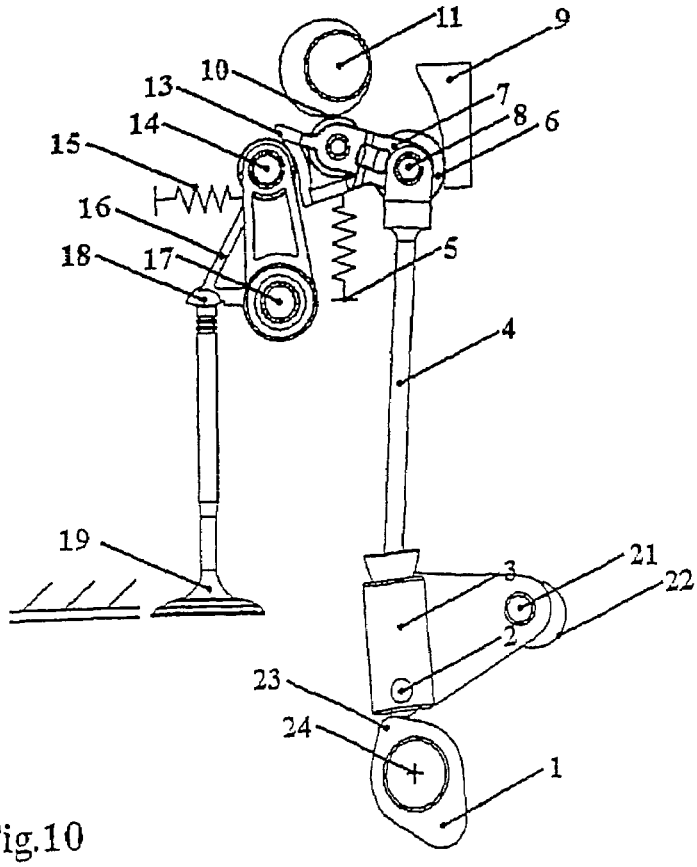
FIG. 10 the variable valve train when the transmission gear is set for a secondary stroke position with eccentric displacement and secondary cam operation.
Figure 11:
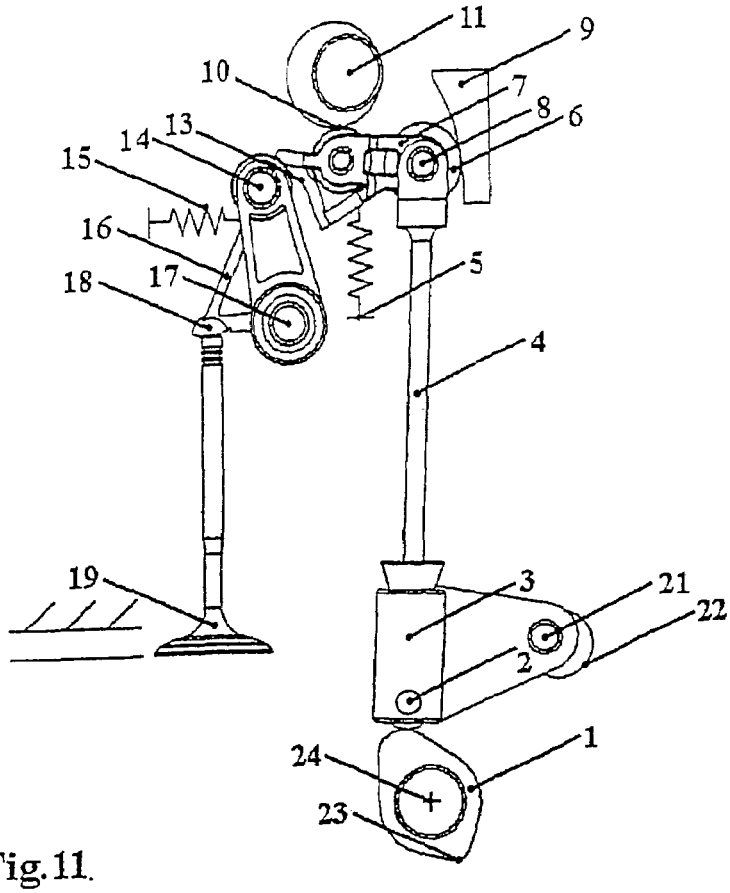
FIG. 11 the variable valve train when the transmission gear is set for a full-stroke position with eccentric displacement and secondary cam.

Illustrated in FIGS. 9 to 11 are various valve stroke positions of the variable valve control for different positions of the eccentric shaft 22 or the coupling point 21.

Figure 12:
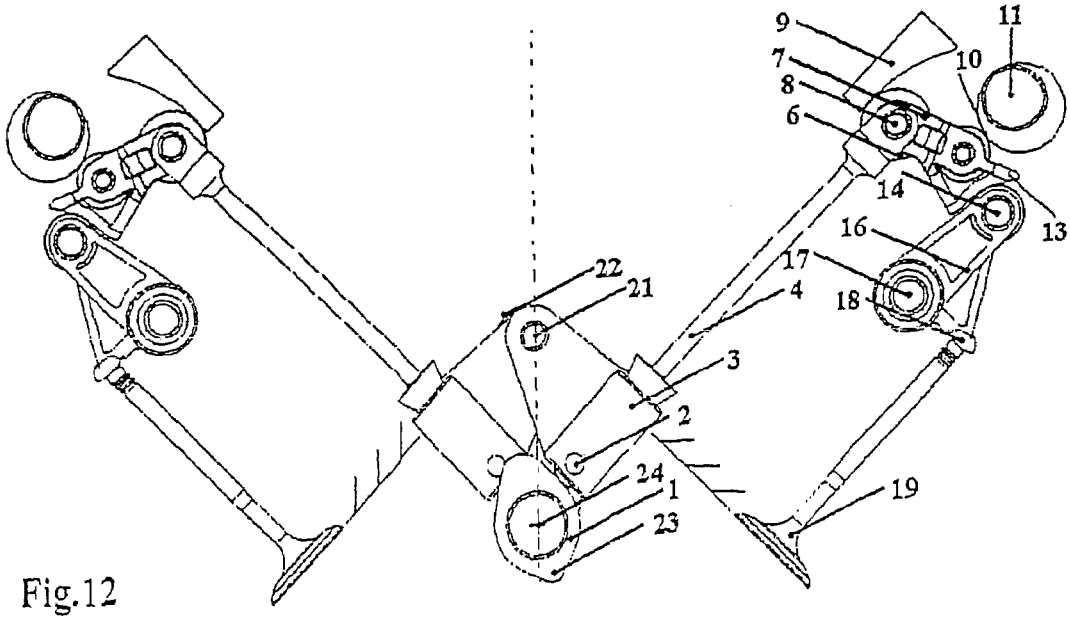
FIG. 12 a third exemplary embodiment of the variable valve train for a V-engine arrangement.

Shown in another exemplary embodiment according to FIG. 12 is the variable valve train for a V-engine arrangement. Advantageous here is a compact solution, in which the tappet 3 can reengage on a common underhead camshaft 1 to drive the gas exchange valves 19. In another exemplary embodiment, which is not shown in greater detail, it is provided that the tappets 3 are driven by different camshafts 1.

Figure 13:
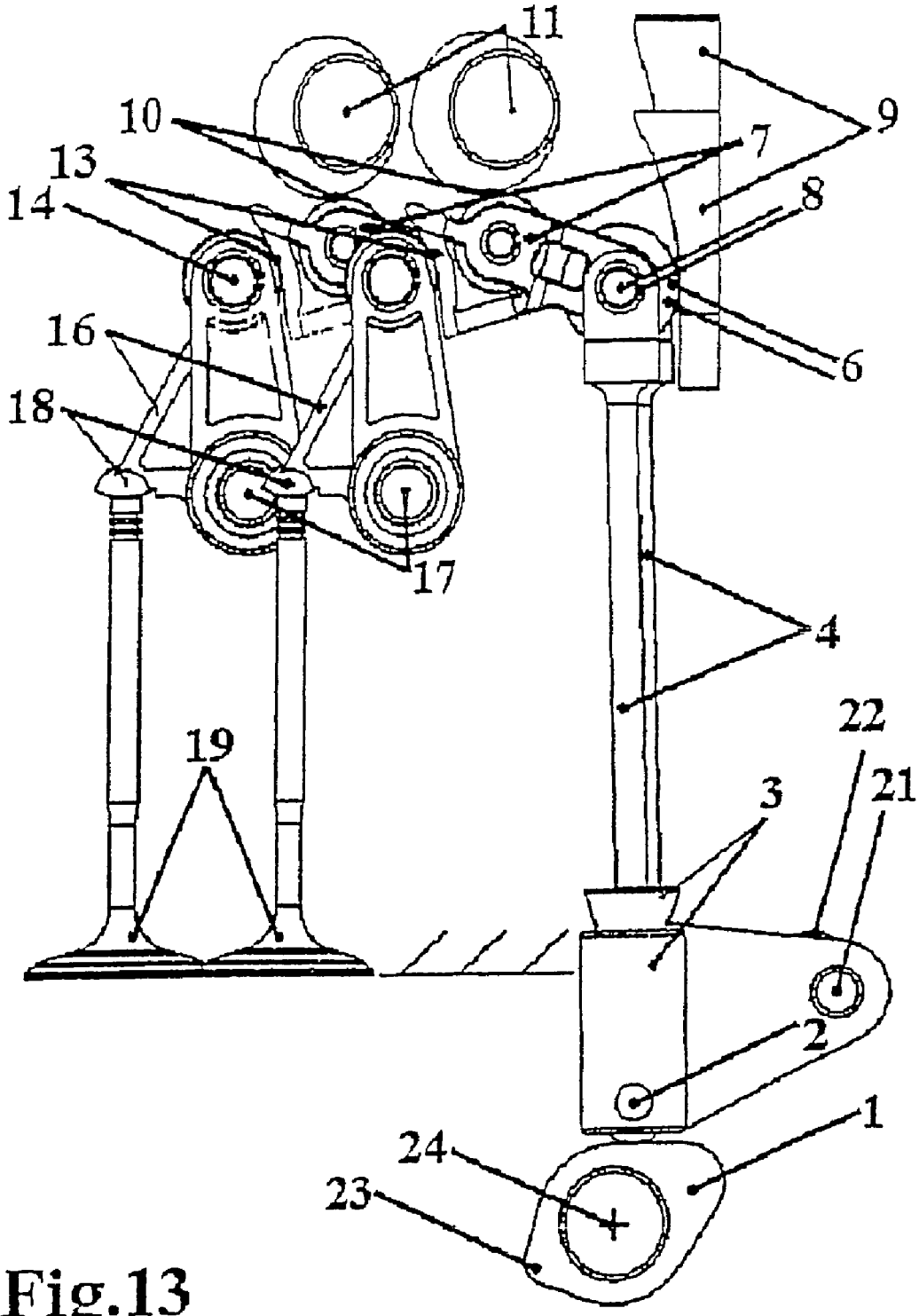
FIG. 13 another exemplary embodiment of the variable valve train with laterally offset valves.

Displayed in FIG. 13 is another exemplary embodiment of the variable valve train, in which the intermediate lever 7 and the lever 16 have different geometries and in which the shifting gear, which preferably is arranged in the cylinder head of the internal combustion engine, has at least two eccentric shafts 11. The gas exchange valves 19 can thereby be variably and differently actuated. In another exemplary embodiment, which is not described in greater detail, it is provided that the lever 16 actuates simultaneously two gas exchange valves 19 by way of a valve bridge.

Figure 14:
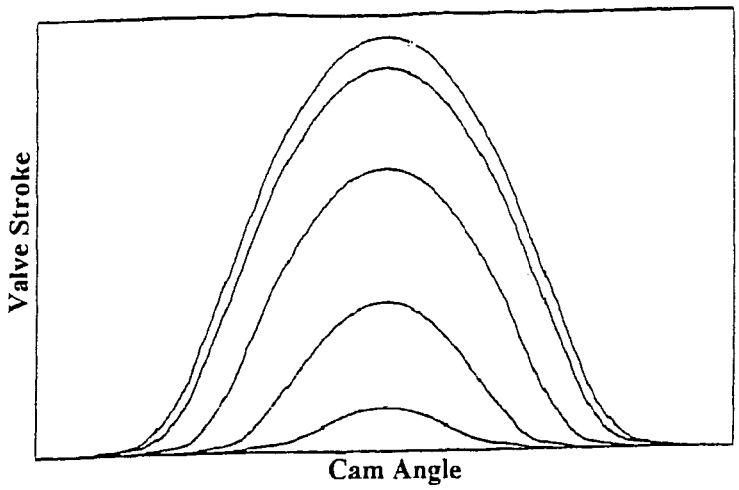
FIG. 14 an exemplary embodiment of a valve stroke curve family of the variable valve train.
Figure 15:
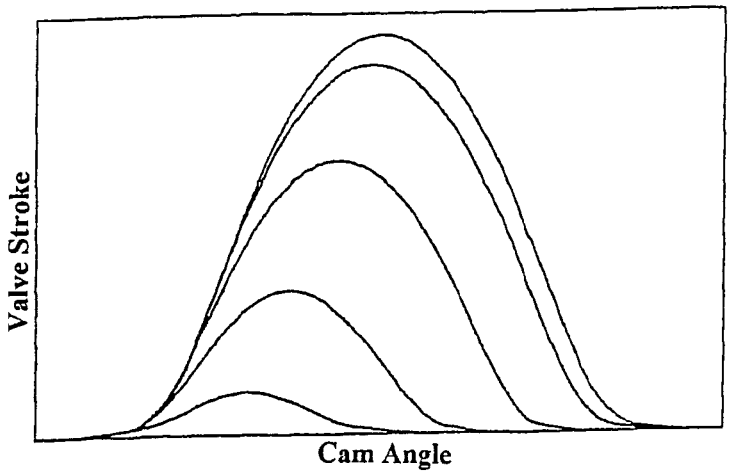
FIG. 15 another exemplary embodiment of a valve stroke curve family of the variable valve train with constant valve opening time point.
Figure 16:
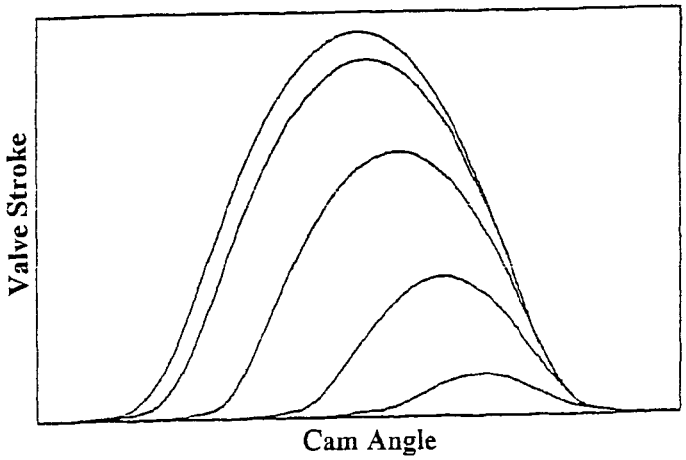
FIG. 16 another exemplary embodiment of a valve stroke curve family of the variable valve train with constant valve closing time point.
Figure 17:
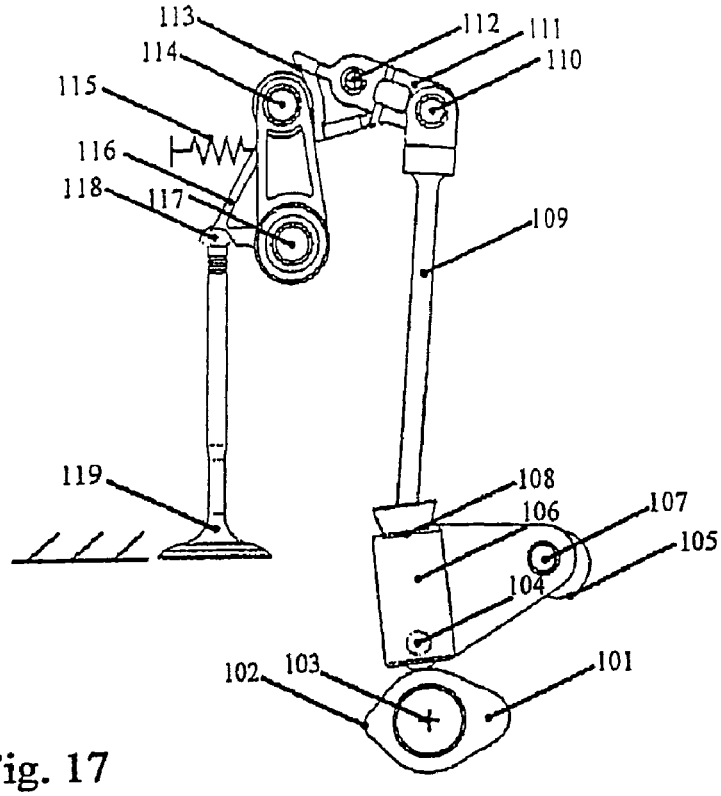
FIG. 17 an exemplary embodiment, in side view, of a variable valve train of a gas exchange valve with underhead camshaft.

Illustrated in FIGS. 14 to 16 are valve stroke curve families of the variable valve train over the cam angle for different exemplary embodiments of the variable valve control and positions of the adjusting element on the tappet 3. Depending on the position of the axle of the tappet 3 in relation to the central axis of the camshaft 24, the position of the stroke maxima or the opening and closing time points of the valve liftings are plotted against the cam angle. Illustrated in FIG. 14 is a symmetrical valve stroke curve family, which is preferably obtained when the axle of the tappet push rod 4 passes through the central axis of the camshaft 24. FIG. 17 shows, in an exemplary embodiment, a variable valve train consisting of a camshaft 101, a tappet 106, a tappet push rod 109, and a transmission gear with a joint 110, by means of which an intermediate lever 111 is linked to the tappet push rod 109 in such a way that the intermediate lever 111, which is rotatably mounted on an axle 112 that is fixed in place and which is driven by the camshaft 101, can move. A lever 116 can be moved over an operating curve 113, by way of which the gas exchange valves 119 are opened and/or closed.

According to FIG. 17, the cam stroke is transmitted by way of the tappet or pivoting lever 106 and a tappet push rod 109 that is articulated with the tappet or pivoting lever 106 by way of the joint 110 onto the intermediate lever 111, whereby the tappet or pivoting lever 106 can be provided also as a pure pivoting lever. Both the tappet and the pivoting lever 106 can be in contact either by way of a sliding contact or a rolling contact with a cam of the camshaft 101. The tappet push rod 109 is linked by way of a ball-and-socket, swivel, or cylindrical joint as a joint or contact 108 to the tappet 106. Deflected by the cam stroke of the camshaft 101 or of a secondary cam 102, the intermediate lever 111 pivots around the fixed axle 112, so that a lever roller 114, which is rotatably mounted on a lever 116, runs on an operating curve 113 of the intermediate lever 111.

The tappet push rod 109 is moved by way of the displacement of an eccentric shaft 105 with its coupling point 107 and the intermediate lever 111 is thereby pivoted relatively around the fixed axle 112 and thus the relative position of the intermediate lever 111 and its operating curve 113 is changed with respect to the lever roller 114. Depending on this positioning, different regions of the operating curve 113 come into contact with the lever roller 114. If the lever roller 114 is in contact with the zero-stroke region of the operating curve 113, no movement of the lever 116 is produced, in spite of the pivoting of the intermediate lever 111, and thus the gas exchange valve 119 is not actuated either. If the lever roller 114 is in contact with the stroke region of the operating curve 113, the lever 116 and, with it, also the gas exchange valve 119 are actuated. The longer the lever roller 114 rolls on the zero-stroke region during displacement of the intermediate lever 111, the shorter it rolls in the stroke region and the smaller is the valve stroke, going all the way down to zero stroke, when only the zero-stroke region of the operating curve 113 is traversed during the cam stroke. Moreover, the opening time of the valve is shortened symmetrically to the maximum cam stroke. Owing to the shifting of the position of the tappet or pivoting lever 106 with respect to the central axis of the camshaft 103, the stroke maximum of the valve stroke curve family shifts, depending on the direction of displacement, to an earlier or later control timing point. In order to be able to ensure a force coupling between all components, it may be necessary to incorporate springs, such as, for example, springs 115. The kind, number, and positioning of the springs 115 depends on the configuration and layout of the transmission gear, whereby, for the force coupling of the transmission gear, springs 115 are provided either on the intermediate levers 111 or on the tappet or pivoting lever 106, depending on the geometry.

Depending on the position and number of fixed axles 112, aligned or nonaligned with respect to one another, different geometries of the intermediate levers 111 and/or levers 116 are employed. In particular for diesel engines, the degrees of freedom in designing the gas exchange conduits are accordingly great.

Figure 18:
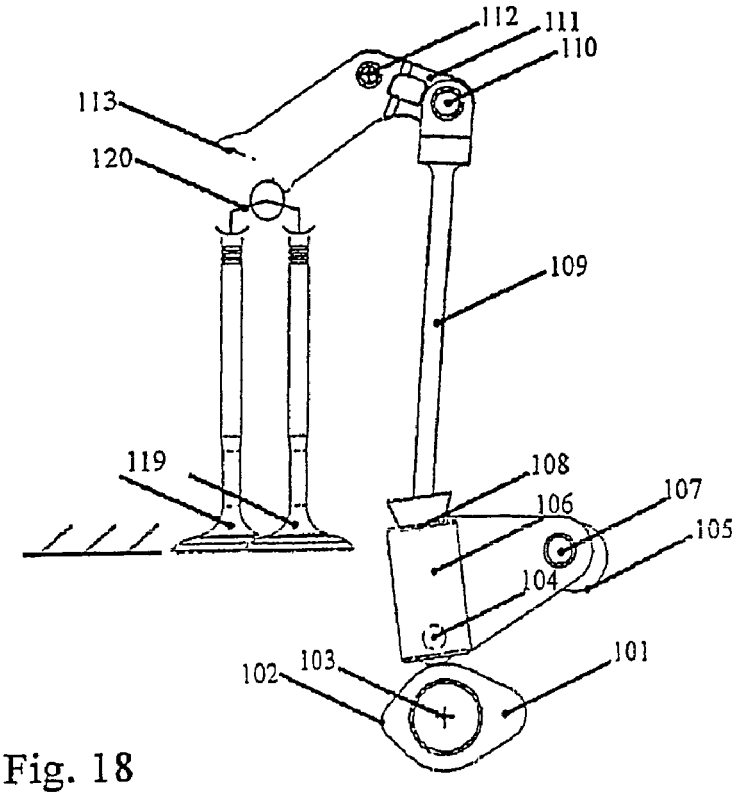
FIG. 18 another exemplary embodiment, in side view, of a variable valve train of a gas exchange valve with underhead camshaft.

By way of the lever roller 113, the exemplary embodiment illustrated in FIG. 18 of the variable valve train actuates, instead of the rocker arm 116, an intermediate member 120, which actuates at least two gas exchange valves 119. The intermediate member can be constructed as a valve bridge.

Figure 19:
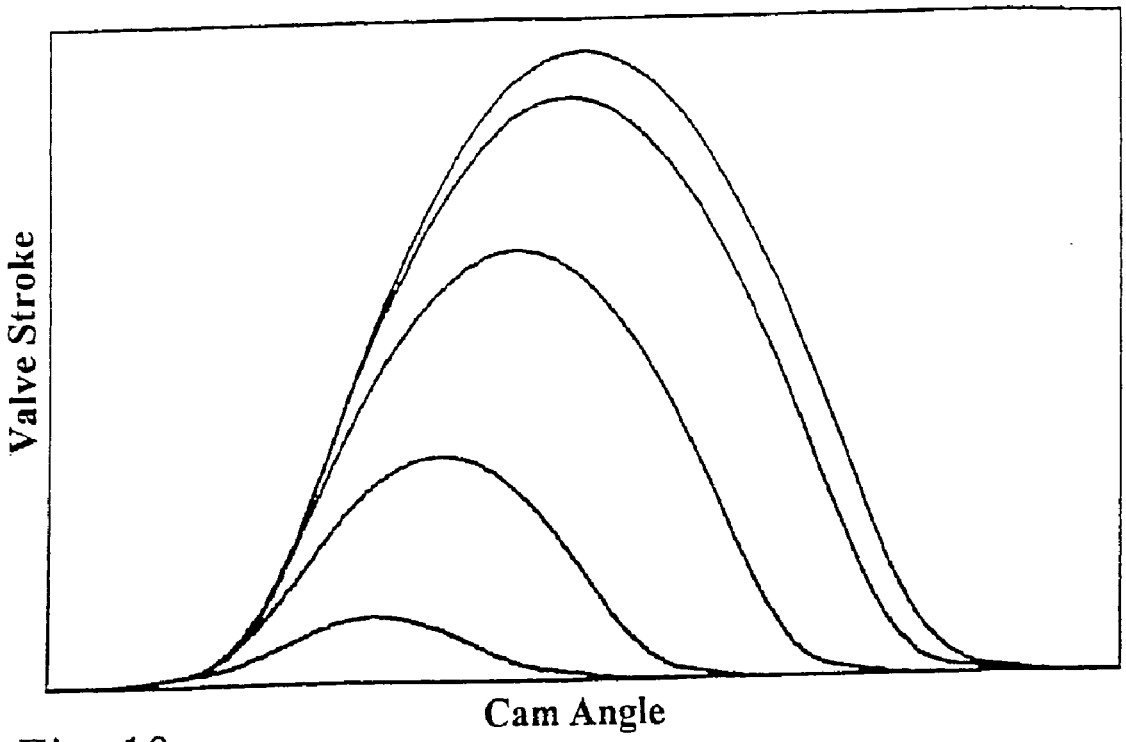
FIG. 19 an exemplary embodiment of a valve stroke curve family of the variable valve train with constant valve opening time point.
Figure 20:
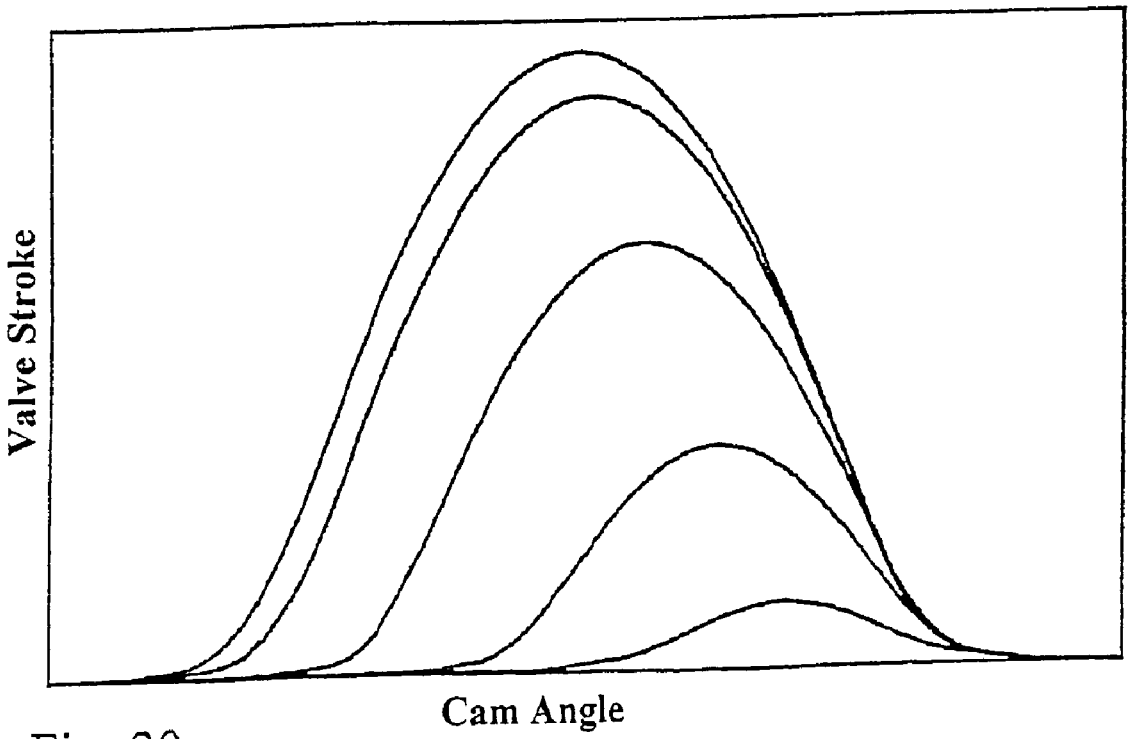
FIG. 20 another exemplary embodiment of a valve stroke curve family of the variable valve train with constant valve closing time point.

Illustrated in FIGS. 19 and 20 are valve stroke curve families for the gas exchange valves 119 of the variable valve train with the valve stroke versus the cam angle for various exemplary embodiments of the variable valve control and positions of the adjusting element, which is formed by the tappet or pivoting lever 106, the eccentric shaft 105, and the coupling point 107. Depending on the position of the axle of the tappet 106 in relation to the central axis of the camshaft 103, the position of the stroke maxima or the opening or closing time points of the gas exchange valve liftings are plotted against the cam angle. The stroke curve family illustrated in FIG. 19 shows a gas exchange valve stroke course with constant valve opening time point and the stroke curve family illustrated in FIG. 20 represents a further exemplary embodiment of the variable valve train with constant closing time point for the valve, whereby these two layout results are to be regarded, as exemplary embodiments for the respectively achievable variation of the valve stroke curve family, as extreme layouts, and layouts lying between these gas exchange valve stroke curve families are equally possible.

Figure 21:
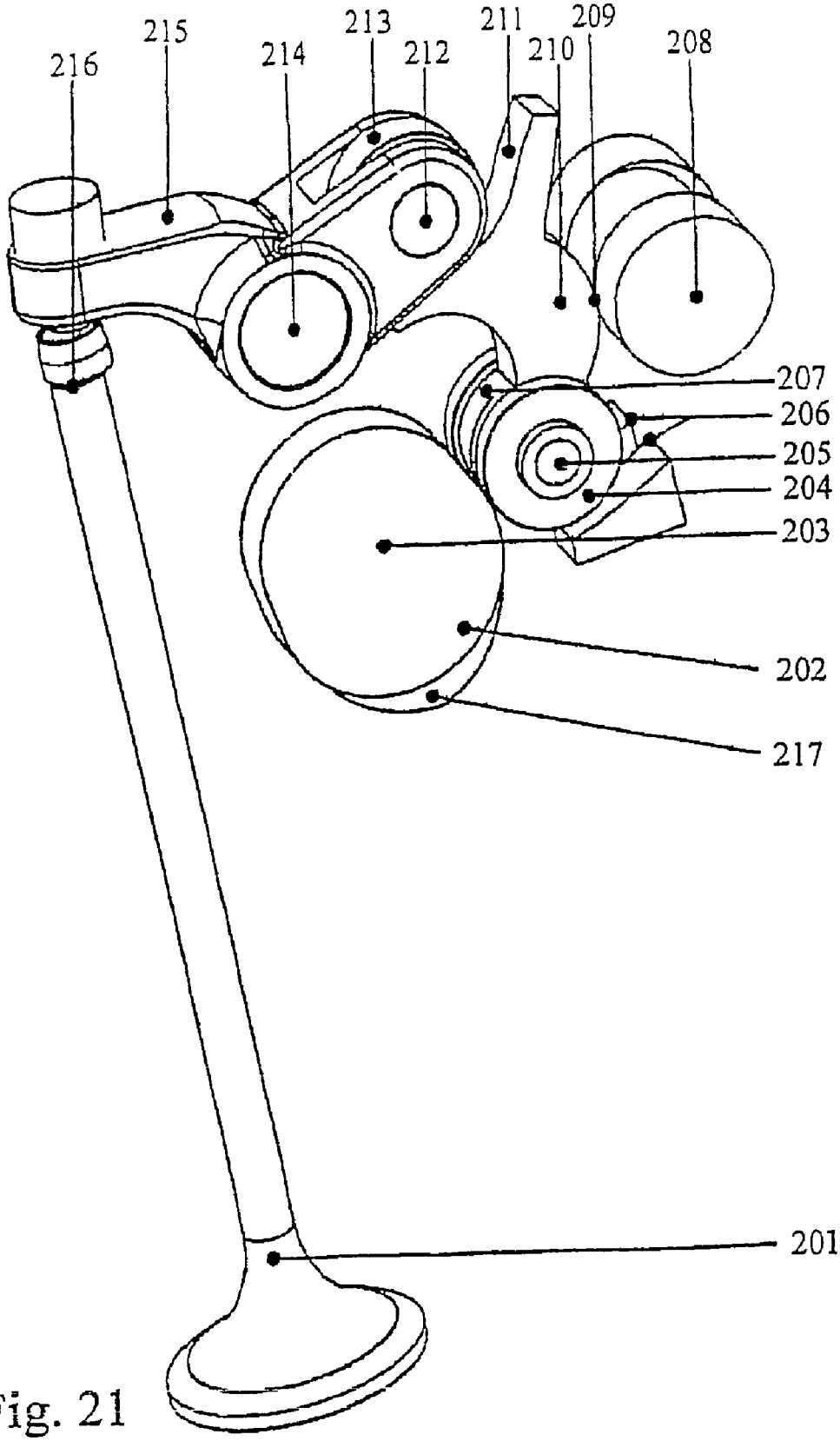
FIG. 21 an exemplary embodiment of a variable valve train of a gas exchange valve with rocker arms in side view.

FIG. 21 shows an embodiment example of a variable valve train, consisting of a camshaft 202, a camshaft roller 207, which rolls on a contour of the camshaft 202 and is deflected. The camshaft roller 207 is rotatably mounted in an intermediate lever 210. The intermediate lever 210 is supported by way of a slide gate roller 204, a contact surface 209, and a lever roller 213. A control shaft 208 rotates at a speed of the camshaft 202 and the intermediate lever 210 is rocked relative to the center of rotation of the slide gate roller 204. A rocker arm or pivoting lever 215 is rotatably mounted in a lever fulcrum 214. A gas exchange valve 201 is actuated by way of the lever 215. The intermediate lever 210 rolls with the slide gate roller 204 in a slide gate 206. In addition, the intermediate lever 210 is supported with the contact surface 209 on the control shaft 208. The contact surface 209 can also be a component of a rotatably mounted roller of the intermediate lever 210.

Deflected by the contour of the camshaft 202, the intermediate lever 210 rocks, so that the lever roller 213, which is rotatably mounted on the rocker arm or pivoting lever 215, runs on an operating curve 211 of the intermediate lever 210. Depending on the positioning by the rotating control shaft 208, different regions of the operating curve 211 come into contact with the lever roller 213. If the lever roller 213 is in contact with the zero-stroke region of the operating curve 211, no movement of the rocker arm or pivoting lever 215 is produced, in spite of the pivoting of the intermediate lever 210, and thus the gas exchange valve 201 is not actuated either. If the lever roller 213 is in contact with the stroke region of the operating curve 211, the lever 215 and, with it, also the gas exchange valve 201 are actuated. The longer the lever roller 213 rolls on the zero-stroke region owing to displacement of the intermediate lever 210, the shorter it rolls in the stroke region and the smaller is the valve stroke, going all the way down to zero stroke, when only the zero-stroke region of the operating curve 211 is traversed during the cam stroke. Moreover, depending on the orientation of the camshaft 202 and of the control shaft 208 with respect to each other, either the opening time point shifts to a later time and the closing time point remains the same, or vice versa. This adjustment can preferably take place by way of a phase shifter.

In order to able to ensure a force coupling among all components, several springs can be incorporated into the system. The kind, number, and positioning of the springs depends on the configuration and layout of the system.

In order to compensate for the valve play between the valve and the valve train components, it is possible to provide a mechanical valve play compensating element 216 or an hydraulic valve play compensating mechanism.

For certain geometric positions of the components of the transmission gear, a zero stroke of a gas exchange valve 201 can be adjusted and thus at least one gas exchange valve 201 for each cylinder can be shut down. The camshaft 202 can further have a secondary lobe 217 on the base-circle diameter of the cam contour of the camshaft 202, by way of which, for each camshaft revolution, a second opening and closing of the intake and/or exhaust valves can take place.

Furthermore, as means for the additional independent valve stroke opening and closing for each camshaft revolution, it is possible to provide a second actuating system for a secondary stroke, whereby, through the second actuating system, the valve opening of the gas exchange valves 201 can take place in a changeable manner and independent of the opening of a primary stroke. For adjustment of the intermediate lever 210 or of the rocker arm or pivoting lever 215, it is possible to provide means for the fine adjustment at the lever roller point 212 and the lever fulcrum 214 of the axle 205 as well as the slide gate 206. The geometries of the valve train actuation of the intermediate levers 210, the rocker arms or pivoting levers 215, the cam contours of the camshaft 202, or the eccentric disk at the control shaft 208 can be designed in such a way that different valve strokes can be adjusted for neighboring valves.

Illustrated in FIGS. 22 and 23 are valve stroke curve families of the variable valve train over the angle of rotation of the control shafts for various exemplary embodiments of the variable valve control and positions of the rotating camshaft 202 and of the control shaft 208 with respect to one another. Depending on the phase shift of the camshaft 202 and of the control shaft 208, the position of the stroke maxima or the opening or closing time points of the valve liftings is plotted against the cam angle.

List of Reference Numbers

1 camshaft
2 cam follower
3 tappet
4 tappet push rod
5 spring
6 slide gate roller
7 intermediate lever
8 axle
9 slide gate
10 first contact surface
11 eccentric shaft
12 second contact surface
13 operating curve
14 lever roller
15 spring
16 lever
17 lever fulcrum
18 hydraulic valve play compensating element
19 gas exchange valve
20 linear guide
21 coupling point

22 eccentric shaft
23 secondary cam
24 central axis of the camshaft
AV spread displaced
A spread fixed
101 cam
102 secondary cam
103 central axis of the camshaft
104 cam follower
105 eccentric shaft
106 tappet or pivoting lever
107 coupling point
108 joint or contact
109 tappet push rod
110 joint
111 intermediate lever
112 fixed axle
113 operating curve
114 lever roller
115 spring
116 lever
117 lever fulcrum
118 hydraulic valve play compensating element
119 gas exchange valve
120 intermediate member
201 gas exchange valve
202 camshaft
203 central axis of the camshaft
204 slide gate roller
205 axle
206 slide gate
207 camshaft roller
208 control shaft
209 contact surface
210 intermediate lever
211 operating curve
212 lever roller center of rotation
213 lever roller
214 lever fulcrum
215 rocker arm or pivoting lever
216 valve play compensating element
217 secondary lobe

What is claimed is:

1. A variable mechanical valve control for an internal combustion engine having an underhead camshaft for adjusting a valve stroke and an opening and closing time of at least one intake and/or exhaust gas exchange valve, comprising:

a transmission gear and at least one tappet push rod, a lever driven by a camshaft for actuating the intake and/or exhaust valve, an intermediate lever linked to a tappet push rod via an axle in such a way that a slide gate roller, which is rotatably mounted on the axle and is driven by the camshaft, is moved in a slide gate, whereby a first contact surface on the intermediate lever is supported on one of an eccentric shaft or a second contact surface and the lever is movable over an operating curve, by means of which the gas exchange valve is opened and/or closed, and whereby, on a tappet provided on the tappet push rod, means are provided for additional shifting of a phase position of valve liftings of the gas exchange valve with simultaneous play-free adjustment of the valve stroke and means are provided for additional independently controllable valve stroke opening and closing for each camshaft revolution, wherein, depending on a displacement of an axial position of the tappet push rod with the tappet in opposing directions in relation to a central axis of the camshaft, the valve opening time points or the valve closing time points are differently adjustable.

2. The variable mechanical valve control according to claim 1, wherein the lever is constructed as one of a rocker arm or pivoting lever.

3. The variable mechanical valve control according to claim 1, wherein one of a path of the slide gate is defined by an arc around a center point of a lever roller and a first portion of the operating curve is defined by an arc around a center point of the slide gate roller.

4. The variable mechanical valve control according to claim 1, wherein, for an internal combustion engine having at least two intake and/or exhaust valves, the corresponding intermediate levers and the levers have different geometries for valve actuation and are not provided on a common axle.

5. The variable mechanical valve control according to claim 1, wherein the lever actuates simultaneously two gas exchange valves by way of a valve bridge.

6. The variable mechanical valve control according to claim 1, wherein the first contact surface of the intermediate lever is a component of a rotatably mounted roller.

7. The variable mechanical valve control according to claim 1, wherein, for certain geometric positions of components of the transmission gear, a zero stroke of a gas exchange valve is adjusted and thus at least one gas exchange valve for each cylinder is shut down.

8. The variable mechanical valve control according to claim 1, wherein the tappet is constructed as a pivoting lever between the tappet push rod and the camshaft.

9. The variable mechanical valve control according to claim 8, wherein, for adjusting the phase position of the valve liftings of the gas exchange valves or of the valve strokes and the valve opening and closing time points, an additional adjusting element is provided on the tappet or pivoting lever.

10. The variable mechanical valve control according to claim 9, wherein the adjusting element comprises an eccentric shaft with a coupling point and is coupled to the tappet or pivoting lever, whereby, by means of a rotation of the eccentric shaft, a preset change of the phase position and valve liftings of the gas exchange valve is effected.

11. The variable mechanical valve control according to claim 9, wherein the tappet is linearly adjustable by means of the adjusting element.

12. The variable mechanical valve control according to claim 1, wherein the adjustment of the intake and exhaust valve liftings with respect to each other is effected separately and differently.

13. The variable mechanical valve control according to claim 1, wherein the camshaft has at least one secondary cam, by means of which, for each camshaft revolution, a second opening and closing of the intake and/or exhaust valve is effected.

14. The variable mechanical valve control according to claim 1, wherein, as means for the additional independent valve stroke opening and closing for each camshaft revolution, there is provided a second actuating system for a secondary stroke, whereby, through the second actuating system, the valve opening of the gas exchange valve takes place in a changeable manner and independently from the opening of a primary stroke.

15. The variable mechanical valve control according to claim 1, wherein a spring is provided for reinforcing a support of the first contact surface on the eccentric shaft or the second contact surface.

* * * * *